United States Patent [19]

Nogueira et al.

[11] 4,209,370

[45] Jun. 24, 1980

[54] PROCESS FOR ELECTROLYSIS OF BRINE BY MERCURY CATHODES

[76] Inventors: Eduardo D. Nogueira, Avda. Mediterraneo No. 47, Madrid (30); Luis A. S. Infanzon, Avid. Valladolid No. 73 trip., Madrid (8); Enrique H. Tezanos, Aniceto Marinas No. 110-6A, Madrid (8), all of Spain

[21] Appl. No.: 840,224

[22] Filed: Oct. 7, 1977

[30] Foreign Application Priority Data

Oct. 8, 1976 [ES] Spain ..... 452.238

[51] Int. Cl.[2] ..... C25B 1/38; C25B 1/40; C25B 9/00

[52] U.S. Cl. ..... 204/99; 204/251

[58] Field of Search ..... 204/251, 99, 128

[56] References Cited

U.S. PATENT DOCUMENTS

| | | | |
|---|---|---|---|
| 1,368,955 | 2/1921 | Matsushima | 204/251 |
| 2,150,775 | 3/1939 | Messner | 204/251 |
| 2,829,096 | 4/1958 | Clement | 204/99 |
| 3,065,163 | 11/1962 | Honsberg | 204/99 |
| 3,102,085 | 8/1963 | Edwards et al. | 204/99 |
| 3,398,080 | 8/1968 | Steffanson et al. | 204/251 |
| 3,694,281 | 9/1972 | Ledoc | 204/98 |
| 3,775,272 | 11/1973 | Danna | 204/98 |
| 3,853,721 | 12/1974 | Darlington et al. | 204/128 |
| 3,864,226 | 2/1975 | Spitzer | 204/99 |
| 3,928,150 | 12/1975 | Rahn et al. | 204/98 |
| 4,046,654 | 9/1977 | Cole | 204/99 |
| 4,107,020 | 8/1978 | Brochier et al. | 204/251 |

FOREIGN PATENT DOCUMENTS

| | | | |
|---|---|---|---|
| 539097 | 11/1931 | Fed. Rep. of Germany | 204/251 |

OTHER PUBLICATIONS

"XR-Membranes", E. I. DuPont & Co., 1969, pp. 1–4.

*Primary Examiner*—R. L. Andrews
*Attorney, Agent, or Firm*—Friedman, Goodman & Teitelbaum

[57] ABSTRACT

The present invention refers to a process for electrolysis of brine by mercury cathodes, being the latter cathode separated from the anode by a porous diaphragm or membrane with diameter of pore such that mercury cannot pass through it.

5 Claims, No Drawings

PROCESS FOR ELECTROLYSIS OF BRINE BY MERCURY CATHODES

Electrolysis (rupture by means of an electrical field) of alkaline halides in solution is an industrial process that is very generalized for production of halogen in an elementary state.

To be specific with respect to its most developed application, the industrial production of chlorine by this process has been employed for 86 years having almost completely replaced the processes of production of chlorine by chemical methods.

Throughout these years the different industrial designs of electrolytic cells have corresponded to three different fundamental types:

(a) Cells in which the electrolyte, sodium chloride, is in a liquid, melted phase.

(b) Cells in which the electrolyte, sodium chloride, is in a liquid phase, dissolved in water, and the cathode is a film of mercury.

(c) Cells in which the electrolyte, sodium chloride, is in a liquid phase dissolved in water, the cathode is of steel, from which hydrogen is given off; and the two electrodes are separated by a diaphragm that facilitates the passage of ions from the anolyte to the catholyte, restraining them in the contrary direction.

These three types of fundamental designs have had a different effectiveness throughout these 86 years.

Type (a) has practically no significant industrial use, due to the limited application that metal sodium has today, and to its high energy cost.

Cells with mercury cathode (type b) offer advantages with respect to the quality of the caustic soda produced and versatility of operation, which fully compensates their greater cost of electrical energy, and they have been preferred throughout this century as compared with diaphragm cells which produce low quality caustic soda.

However, the increasing world awareness of the danger of mercury in the environment has had a repercussion on the demand for plants of this type which have been displaced in the last ten years by designs with diaphragm cells.

This evolution towards the diaphragm cell, is very much conditioned by the serious discussion of the alleged danger of mercury and has led to the general development of different technical processes to avoid pollution by mercury. In general terms, these processes have achieved a reduction of the emission of mercury into the environment up to the extremes such that they have slowed down the trend towards diaphragm cells.

In recent years a new model or type (c) cells has begun to be developed, in which the separator diaphragm is a porous membrane with chemical capacity to exchange cations, without the possibility of anionic exchange. This type of membrane makes difficult the passage of anion chloride through it, on the other hand facilitating the passage of the cation from the anolyte to the catolyte. In this way it is possible to produce chlorine and caustic soda in intermediate conditions that lie between the results of the mercury cells and those of the classic diaphragm cells.

These cells, in an incomplete state of development, constitute an implicit recognition by industrialists of their desire to find a process of sodium chloride electrolysis with the advantages and quality of mercury cells but without their disadvantages of pollution.

The subject of this invention is a device which makes it possible to achieve both objectives by means of a new combination of the general techniques previously described.

The invention maintains the basic design of mercury cells and consists of an electrolytic cell with anode and positive pole for the discharge of chlorine and a cathode, or negative pole, constituted by a film of mercury, where the sodium is discharged. In the invention of this memorandum this cathode is separated from the anodic enclosure by a membrane or diaphragm, conductors of electricity exclusively in the form of ions, which prevents passage through the metal mercury.

In accordance with this invention the diameter of the pores of the diaphragm correspond to the ratio:

$$\text{Diameter of pore: } \leqq \frac{1.5 \times 10^{-1}}{\Delta P} \text{ mm.}$$

in which $\Delta$ P is the difference of pressure existing between the mercury and the anodic liquid, expressed as N. cm.$^{-2}$ (Newton per square centimeter).

The existence of this membrane or diaphragm prevents the production of short circuits between the two poles of the cell. Hereinafter we shall refer to the two terms using only one term, that of membrane, more suitable for the embodiment of this invention.

In this way a reduction to a minimum distance of separation between the two electrodes is obtained without the least danger of a short circuit, a limiting factor in the regulation of this inter-electrode separation in existing mercury cells.

A second beneficial effect of this invention is based on the possibility of designing cells with mercury cathode in which the form that this cathode adopts (liquid) is adjusted to the particular criterion of each case, without depending on the classic form of horizontal film. In this way through a special design of the membrane and suitable anodic support structure, designs may be obtained in which the direction of flow of the mercury forms an angle with the horizontal plane of any value comprised between 0 and 100 centesimal degrees. A special case, therefore, is the possibility of the cathodic mercury film circulating through the cell in the vertical direction. This arrangement of the cathode has the great advantage of being compact, making possible designs of cells with a production capacity per unit of surface of plant occupied up to thirty times greater than that of existing mercury cells, or densities of current in low frequency operations, for the same production capacity with consequent reduction of the energy necessary for the production of a determined amount of chlorine.

The design of a vertical mercury cathode has been attempted on repeated occasions, its industrial application repeatedly failing because of the difficulty of obtaining a descendant mercury film sufficiently close to the anode not to represent a high energy cost but with the safety margin that possible alterations will not originate a shortcircuit.

In the process that is the subject of this invention, such a risk of shortcircuiting does not exist, as has been said previously because the presence of the membrane prevents it.

A third advantage of this invention is based on the fact that on eliminating the danger of short circuits, the average life of the anode is increased, both if the latter is the classic graphite anode and if it is the modern metal type, by reducing its wear and tear.

A fourth advantage of this invention is derived, for horizontal cells from the elimination of the disturbance produced by the falling of particles onto the mercury cathode film. In existing cells without an intermediate membrane the fall of particles (0.5–2 cm.) eroded from the flexible covering of the cell produces alterations in the mercury layer. Such alterations have the double disadvantages of causing discontinuous waves of mercury, which increase the danger of a short circuit, and of uncovering parts of the lower steel sheet which, because of its lesser overpressure for the discharge of hydrogen originates a greater production of this element, with important losses in efficiency of current and in the richness of the chlorine.

For both reasons, these alterations make necessary a periodic cleaning of the bottom of the existing mercury cells. This periodic cleaning, in addition to obvious labour costs, represents costly interruptions of production and a greater degree of pollution of the brine by mercury at the moment of a short in the electrical field in which the mercury ceases to be protected from oxidation by cathodes.

In the type of cell described in this memorandum, this possible fall of particles does not produce these effects because the membrane prevents them from reaching the mercury, with the consequent advantage of a high degree of regularity and prolonged periods of operation.

A fifth advantage of this invention is based on the fact that pollution of the brine by mercury is reduced: previously an explanation has been given of the advantageous incidence provided by the prolonged period of operation on the pollution of the brine by mercury oxidised to its cationic form. An additional effect in this connection is the reduction of the oxidant potential of the chlorine dissolved in the layer of brine in contact with the mercury film. In view of the fact that the membrane, because of the small size of its pores, makes difficult the transport of anions or molecules, facilitating only the transport of cations, the concentration of chlorine dissolved in the said layer is lower than the concentrations existing in other types of cells with mercury cathode. Therefore, the next oxidant potential to which the mercury is subjected at a given cathodic tension is lower than that which is usual, consequently, the content of mercury dissolved in the brine must be reduced below its normal concentration 5–15 ppm.

A consequent advantage of this reduction of pollution is the reduction of loss of mercury in the inventory of the plant.

A sixth advantage of this invention consists of the reduction of loss of efficiency of the cathodic current. On making difficult the passage of molecules as has been mentioned previously for the reduction of pollution, the oxidant potential of the chlorine dissolved in the brine is reduced, in the vicinity of the cathode, with which the potential of retrodissolution of the amalgamated sodium is reduced.

A seventh advantage consists of the elimination of the pollution of chlorine by hydrogen, which is usual in existing cells.

On the cathode where the hydrogen is given off being separated by a membrane, this gas may be collected independently, because it cannot traverse the membrane. Thus on the one hand the danger of its being mixed with chlorine is avoided and on the other hand the disadvantages of its handling as incondensable in the stage of compression and liquidation of chlorine.

An additional advantage of this invention consists of the possibility of designing mercury cells in which this cathode and the brine circulate in counter current, with the advantage of functioning that this system entails.

It should be pointed out, however, that even when membranes with cationic interchange are employed, as an example in the drawing up of this memorandium, this invention is applied to any type of membrane or porous diaphragm which, maintaining the preceding condition of diameter of pore, in order to prevent the passage of mercury through it, permits the flow of ions, irrespective of what they are, maintaining in itself a high electrical resistance.

As a demonstration of what has been expounded previously, the following is stated:

EXAMPLE 1

An electrolytic cell is employed with vertical cathodic arrangement with the following characteristics:

(a) NAFION membrane
(b) Surface of interelectrode membrane: 2.3 $cm^2$, r=0.8 cm.
(c) Pressure in the mercury cathode enclosure 10 $kg/cm^2$, over atmospheric pressure.
(d) Pressure in the anodic enclosure: atmospheric
(e) Concentration of brine in the anodic enclosure: 250 g/l
(f) $RuO_2/Ti$ anode
(g) Active anode surface 0.45 $cm^2$
(h) Temperature of electrolyte operation 55° C.
(i) Average temperature of the mercury: 20° C.

In these conditions chlorine is generated in the conditions defined in the following table:

| Density of anodic current, $mA/cm^2$. | Cell voltage |
|---|---|
| 20 | 2.73 |
| — | — |
| — | — |
| 80 | 3.11 |
| — | — |
| — | — |
| 160 | 3.25 |
| — | — |
| 200 | 3.29 |
| 400 | 3.62 |
| 500 | 3.79 |
| 600 | 3.90 |
| 800 | 4.26 |
| 1000 | 4.5 |

EXAMPLE 2

An electrolytic cell is employed with horizontal cathodic arrangement, with the following characteristics:

(a) NAFION membrane
(b) Surface of interelectrolytic membrane: 2.3$cm^2$, r=0.8 cm.
(c) Pressure in the mercury cathode enclosure 0.1 $kg/cm^2$ over atmospheric pressure.
(d) Pressure in the anodic enclosure: atmospheric
(e) Concentration of brine in the anodic enclosure: 250 g/l
(f) Anode of $RnO_2/TiO_2/Ti$
(g) Active anodic surface 0.45 $cm^2$
(h) Temperature of electrolyte operation 55° C.
(i) Average temperature of the mercury: 20° C.

In these circumstances chlorine is generated in the conditions defined in the following table:

| Density of anodic current mA/cm$^2$ | Cell voltage, V |
|---|---|
| 20 | 2.65 |
| 80 | 3.15 |
| 160 | 3.35 |
| 200 | 3.40 |
| 400 | 3.75 |
| 500 | 3.90 |
| 600 | 4.05 |
| 800 | 4.35 |
| 1000 | 4.70 |

What is claimed is:

1. A process for the electrolysis of brine by mercury cathode, said process comprising:

providing an electrolytic cell;

dividing said cell into an anolyte compartment for the discharge of chlorine and a catholyte compartment by positioning a membrane in said cell;

providing said membrane with porous means impervious to passage of mercury and electrolyte therethrough and previous to passage of ions therethrough for preventing short circuits between anode and cathode poles of said cell;

employing film of mercury as the cathode;

continuously flowing said film of mercury across said membrane; and using said film of mercury to continuously remove from said cell, as an amalgam, metal deposited therein.

2. The process according to claim 1, including directing the flow of said film of mercury in a horizontal direction across said membrane, and separating the flow from the anolyte compartment by making said membrane continuous across said cell.

3. The process according to claim 1, including directing the flow of said film of mercury across said membrane in a direction other than horizontally.

4. The process according to claim 1, including directing the flow of said film of mercury in a vertical direction across said membrane.

5. The process according to claim 1, including providing said membrane with pores with diameter of each pore being in accordance with the equation:

$$\text{Pore Diameter (in mm)} \leqq \frac{1.5 \times 10^{-1}}{\Delta P}$$

where $\Delta$ P is the pressure difference between the mercury and the anodic liquid, expressed in Newtons/per square centimeter (N.cm$^{-2}$).

* * * * *